United States Patent [19]

Hood

[11] 3,933,397

[45] Jan. 20, 1976

[54] BEARING AND SUPPORT STRUCTURE FOR SPEED RACING ROLLER SKATE

[76] Inventor: John C. Hood, 4008 S.W. 24th St., Oklahoma City, Okla. 73102

[22] Filed: May 22, 1974

[21] Appl. No.: 472,488

[52] U.S. Cl. ..... 308/180; 301/5.7

[51] Int. Cl.[2] ..... A63C 17/22

[58] Field of Search ..... 308/180; 301/5.3, 5.7

[56] References Cited

UNITED STATES PATENTS

| | | | |
|---|---|---|---|
| 2,519,927 | 8/1950 | Pedu, Jr. | 301/5.7 |
| 2,534,401 | 12/1950 | Blaes | 301/5.7 |
| 2,622,931 | 12/1952 | Petrelli | 301/5.7 |
| 2,697,010 | 12/1954 | Hirschmugl | 301/5.3 |

*Primary Examiner*—M. Henson Wood, Jr.
*Assistant Examiner*—Michael Mar
*Attorney, Agent, or Firm*—Laney, Dougherty, Hessin & Fish

[57] ABSTRACT

A bearing and support structure for a speed racing roller skate including a support plate, a truck projecting downwardly from the center of the support plate, an axle projecting laterally and horizontally from the truck and extending into a cylindrical bearing sleeve. The cylindrical bearing sleeve is provided with an internal annular bearing spacer flange intermediate its ends, and a first ball bearing assembly is disposed around the axle within the sleeve and adjacent the annular spacer flange. A second ball bearing assembly is disposed inside the sleeve adjacent the spacer flange arouund the axle and on theopposite side of the spacer flange from the first bearing assembly. A nut is threaded on the end of the axle to retain the bearings and sleeve in concentric position around the axle, and at a particular axial position thereon. A wooden wheel concentrically surrounds, and is bonded to, the cylindrical sleeve.

14 Claims, 3 Drawing Figures

BEARING AND SUPPORT STRUCTURE FOR SPEED RACING ROLLER SKATE

BACKGROUND OF THE INVENTION

Field of the Invention

This invention relates to bearing structures, and more particularly, to a bearing and support structure used in roller skates of the type used for speed racing.

Brief Description of the Prior Art

In speed racing on roller skates, a portion of the success of the racer can be attributed to the skill, strength and stamina of the racer, and a portion to the particular skate construction which characterizes the skates worn by the racer. In the latter regard, the type of wheel construction used on roller skates, and especially the types of bearings employed in such wheels, is of great importance, since the frictional drag which is offered by the bearing structure to the turning of the wheel is a major factor in the speed which can be attained by the skater.

Efforts have previously been directed to the devising of improved bearing structures for use in speed racing roller skates. Such bearing structures generally must take into account several characteristics of roller skates of the speed skating type. Thus, it has been found that the best material for the construction of the wheels of speed racing roller skates is wood, and a considerable amount of investigation and research has gone into the particular types of woods which function most effectively for this purpose. Since wood is the preferred material of wheel construction in the best speed skates, bearings used to support these wheels on the axles of the skates must take into consideration several properties of wood which impose limitations on the types of bearings which can be employed. Thus, for example, the wooden rollers wear away more rapidly, and get "out of round" more quickly, than would metal wheels, and wooden wheels also tend to undergo cracking or splitting when subject to abusive usage, or even when merely subjected to long periods of usage.

It has also come to be required in most roller skating contexts, including speed racing, that the axles which support the wheels of the skates do not project laterally beyond the outer sides or peripheries of the wheels of the skates so as to expose a relatively sharp gouging or penetrating member which can deface the walls adjacent the rink, or result in injury to persons who may collide with the skater. Moreover, each wheel is generally mounted on its axle in a cantilevered fashion with respect to the point of mechanical support of the axle at the truck which projects downwardly from the foot plates of the skates. The cantilevered mounting arrangement imposes a high bending moment on the axles due to loading of the axles via the wheels mounted thereon at points spaced a significant distance from the inward point of support of each axle at the truck.

One type of bearing structure which has previously been used is one which provides a generally cylindrical sleeve positioned concentrically around the axle and having a large bore extending therethrough which is divided or partitioned by an annular spacer flange which is located substantially midway of the cylindrical sleeve. A large opening is provided through the center of the annular spacer flange to accommodate extension of the axle therethrough. A pair of annular ball bearings are positioned inside the sleeve and on opposite sides of the spacer flange.

In the described bearing structure, the cylindrical sleeve has generally been made shorter in length than the thickness through the wooden wheel which it supports, with the result that incomplete support near the outer end of the wheel at the surface of the bore therethrough has been provided. Less than optimum overall radial support is therefore provided to prevent the wheel getting out of round, and becoming cracked as a result of hard use and stresses acting on the outer periphery of the wheel. Moreover, in the described bearing structure, the generally cylindrical sleeve has not been firmly bonded to the wall of the bore through the wooden wheel which is mounted on the cylindrical sleeve, and separation sometimes occurs which, in extreme circumstances, will even allow the wooden wheel to turn upon the cylindrical sleeve.

BRIEF DESCRIPTION OF THE PRESENT INVENTION

The present invention provides an improved bearing structure for use in roller skates of the type used in speed skating. Broadly described, the bearing structure of the present invention comprises an elongated cylindrical sleeve having a bore of non-uniform diameter extending from one end of the sleeve to the other. The bore is partitioned into a pair of bearing receiving chambers by means of an annular spacer flange which projects radially inwardly from the internal wall of the sleeve, and which is centrally apertured or bored to accommodate extension of a wheel axle therethrough. The sleeve is further characterized in having a plurality of axially extending, circumferentially spaced ribs projecting over a portion of the length of the sleeve on the outer periphery thereof. These ribs bite into and grip the internal wall of a wooden skate wheel, and also provide a space between the outer periphery of the cylindrical sleeve and the internal wall of the bore through the wheel to accommodate a glue or mastic material which firmly and tenaciously bonds the sleeve to the wooden wheel.

Projecting coaxially into the sleeve is the axle of the skate. The axle further extends through a pair of ball bearings which are mounted in the bore of the sleeve on opposite sides of the annular spacer flange which projects radially inwardly from the internal wall of the sleeve. In a preferred embodiment, the sleeve has a length which is substantially the same as the thickness of the wooden wheel mounted thereon, and the axle terminates short of the outer end of the sleeve so as to protect the exposed end of the axle. The bearings mounted around the axle and inside the sleeve have an inner race in contact with the axle and an outer race in contact with the cylindrical sleeve.

An important object of the present invention is to provide an improved bearing and support structure for speed racing roller skates, which bearing and support structure reinforces and provides enhanced mechanical strength to the wooden wheels used on such skates.

Another object of the invention is to provide a bearing and support structure for use in mounting the wooden wheels on racing skates used in racing roller skating, which bearing and support structure is more firmly bonded to the surrounding wooden skate wheel, and which is balanced with respect to the forces acting on the bearing in such a way that less frictional drag acts during the skating to oppose the rotational movement of the wheels mounted on the skates by means of the bearing and support structure.

A further object of the invention is to provide a high mechanical strength support structure used in combination with ball bearings in a wheel assembly used on roller skates used in racing.

Additional objects and advantages of the invention will become apparent as the following detailed description is read in conjunction with the accompanying drawings which illustrate the invention.

DETAILED DESCRIPTION OF A PREFERRED EMBODIMENT OF THE INVENTION

Figure 1:
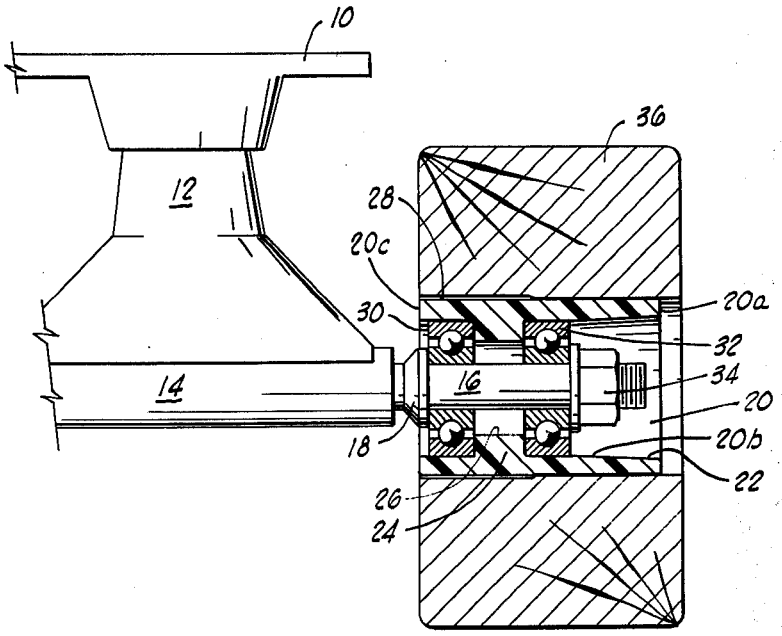
FIG. 1 is a view partly in elevation and partly in section illustrating, primarily in section, the bearing and support structure of the present invention as it appears when mounted on the axle of a roller skate.
Figure 2:
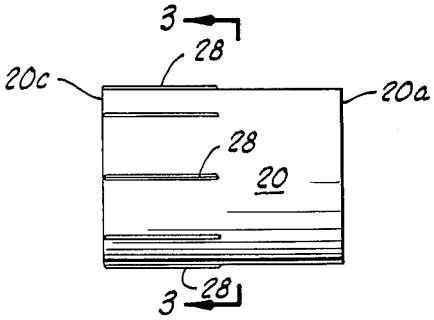
FIG. 2 is a side elevation view of a cylindrical sleeve forming a portion of the bearing and support structure of the present invention.
Figure 3:
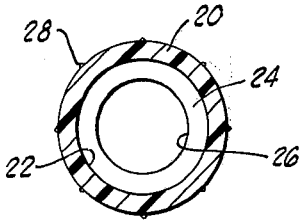
FIG. 3 is a sectional view taken along line 3—3 of FIG. 2.

Referring initially to FIG. 1 of the drawings, a foot support plate 10 of a roller skate is illustrated as being supported upon a downwardly projecting truck 12. The truck 12 has secured to the lower side thereof, an axle housing 14 from which project in opposite directions, a pair of horizontally extending axles 16. The axles are generally cylindrical in shape, and carry a hub 18 or other suitable retaining or stop structure to prevent inward movement of the wheels and bearings toward the truck 12.

In addition to the axle 16, the bearing and support structure of the present invention includes a generally cylindrical sleeve 20 which has a bore 22 formed therethrough and extending from one end of the sleeve to the other. The bore 22 is not of uniform diameter over the length of the sleeve, but includes a portion of changing diameter which extends from the outer end 20*a* of the sleeve to a point 20*b* spaced inwardly from the outer end of the sleeve along the bore. The described taper of the bore 22 is very slight, and the diameter of the bore decreases gradually from the outer end of the sleeve to the point 20*b* inwardly in the sleeve. This configuration of the bore is provided for a purpose hereinafter explained in greater detail.

The sleeve 20 further has formed internally in the bore 22, an annular spacer flange 24 which projects radially inwardly and defines a central opening or aperture 26 which is located concentrically in the sleeve 20 with respect to the bore 22. On the outer periphery of the sleeve 20, there are formed a plurality of axially extending, circumferentially spaced ribs 28 which are preferably generally triangular shaped in cross section, with an edge at the outer side thereof. The ribs 28 project from the inner end 20*b* of the sleeve 20, and extend approximately half the length of the sleeve.

Dimensions and material of construction of the sleeve 20 are of some significance and importance to the achievement of some of the advantages afforded by the bearing and support structure of the present invention. The sleeve is preferably constructed of a high density synthetic resin material of high mechanical strength, and the most suitable material of construction which I have found is a polycarbonate material sold under the tradename Lexan by the General Electric Company of Schenectady, New York. This material has very high impact strength, and can withstand heavy loading in compression. It enables the sleeve 20 to retain a truly round cross sectional configuration after molding. Other synthetic resin materials, such as polyester and polyacetal resins, can, however, also be employed. The sleeve is preferably molded to a thickness, as measured in a radial direction through the outer end of the sleeve, of about 0.125 inch. As to the other dimensions of the sleeve, the sleeve is preferably formed to have a length of about 1.62 inches. This length enables the sleeve to fit well within, and extend from one side to the other of, the standardbr conventional wooden wheels used on racing skates. These wheels are substantially universally made of about 1.62 inches thickness as measured from the inside of the wheel near the skate to the outside thereof. One other type of wheel is currently sometimes used in roller skate racing, with such wheel being an oversized wheel of 2.25 inches thickness. It is to be understood that the sleeve 20 of the present invention, while functioning best with the conventional 1.62 inches wheel, also functions well with the 2.25 inches wheels and affords advantage even when used with wheels of this size.

The distance from the inner end 20*b* of the sleeve 20 to the inwardly facing shoulder formed by the annular spacer flange 24 is about 0.36 inch, the distance through the flange, measured axially (parallel to the axle 16) is about 0.36 inch, and the distance over which the tapered, slightly diametrically diminishing portion of the bore 22 extends is about 0.60 inch. From the point 20*b* where this taper terminates to the outwardly facing shoulder formed by the annular spacing flange 26 is a distance of about 0.36 inch.

Positioned inside the spacer 20 in the bore 22 and adjacent the annular spacer flange 26 are a pair of ball bearings 30 and 32. The inner ball bearing 30 is positioned so that its inner race bears against the axle 16 and, in an axial direction, against the hub 18. The outer race fits closely within the bore 22 of the sleeve 20 and also bears in an axial direction against the shoulder formed by the annular spacer flange 26. The outer ball bearing 32 is similarly located, with its inner race surrounding and bearing against the axle 16, and its outer race positioned within and bearing against the sleeve 20. It will be noted that the outer race 32 seats in a portion of the bore 22 which is of uniform diameter and which lies just inwardly of the tapered, diminishing diameter portion of the bore 22. The races 30 and 32 are retained in abutting contact with the annular spacer flange 26 by the shoulder 18 acting in cooperation with a lock nut 34 which is threaded on the outer end of the axle 16.

The wooden skate wheel used in the bearing and supporting assembly is designated generally by reference numeral 36. The skate wheel 36 is a generally cylindrical element having a central bore of substantially uniform diameter formed therethrough. The dimensions of the types of wooden skate wheels used in racing skates have already been described. The types of woods of which such wheels for racing skates are made have been the subject of extensive investigation. I have found that a wood which is preferably employed in the bearing and supporting structure of the present invention is alder wood. This wood seems to retain its cylindrical shape over longer periods of time, and to afford a better friction surface for racing.

When the bearing and support structure of the present invention is assembled, the sleeve 20 is first coated with an adhesive or mastic material such that the adhesive material forms a thin layer around the entire outer periphery of the sleeve 20, and between the ribs 28. The thickness of this layer of adhesive does not exceed the thickness, in a radial sense, of the ribs 28. The sleeve 20 is then pushed into the bore through the wooden wheel 36 and no resistance to this movement of any significance is encountered as the unribbed portion of the sleeve 20 is first advanced into the bore through the wheel 36 from the inside of the wheel toward the outer side thereof.

When the ribs 28 commence to enter the bore through the wheel 36, however, the ribs do displace some of the wood or bite into the inner surface of the bore through the wheel by reason of the ribs being made slightly larger, in an outside diameter sense, than the diameter of the bore through the wheel. Thus, the sleeve 20 must be forced the remainder of the way into its seated position in the bore through the wheel 36, and in thus seating the sleeve 20, the ribs 28 are caused to bite into and engage the surrounding wood of the wheel. Moreover, in the course of positioning the sleeve 20 within the wooden wheel 36, the adhesive or mastic material carried around the outer periphery of the sleeve 20 fills the entire space between the ribs and outer periphery of the sleeve, and the defining surface of the bore through the wheel 36. Thus, when the sleeve has been seated within the wheel 36 in the position shown in FIG. 1, the adhesive is then allowed to set up and establish a firm, uniform bond between the sleeve and the wheel over a large area equivalent, essentially, to the entire outer periphery of the sleeve 20.

I have found that the bearing and supporting structure of the present invention provides a minimum of frictional resistance to the rotation of the wheels 36 on the axles 16 so that better performance of the racing skater can be realized. Moreover, the use of the bearing and supporting structure imparts an extended effective service life to the wooden wheels employed in racing skates, and seems to aid substantially in retaining the wheels in a true round condition and in preventing cracking or splitting of the wheels when they are subjected to hard or abusive use. Further, in the employment of the bearing and supporting structure of this invention, the free outer end of the skate axle is in a protected position and is not exposed so as to gouge or impale objects or people who may come in contact with the outer end of the axle.

Although a preferred embodiment of the invention has been herein shown and has been described in detail, it will be understood that various changes and innovations can be made in the described structure without departure from such principles. All changes and innovations of this type are therefore deemed to be circumscribed by the spirit and scope of the present invention, except as the same may be necessarily limited by the appended claims or reasonable equivalents thereof.

What is claimed is:

1. An improved bearing and support structure for use in roller skates comprising:

an elongated cylindrical sleeve having a bore of non-uniform diameter extending from one end of the sleeve to the other end thereof;

an annular spacer flange projecting radially inwardly into the bore from the sleeve and spaced axially inwardly in the bore from the opposite ends of the sleeve, said flange partitioning the bore into a first portion of uniform diameter extending from one end of the sleeve to the flange, and a second portion which includes a bearing seat zone of uniform diameter adjacent said flange with the remainder of said second portion extending from said bearing seat zone to the second end of said sleeve and continuously increasing in diameter from said bearing seat zone to said second end of the sleeve;

a skate axle extending into said bore concentrically in the sleeve from said one end at least past said bearing seat zone;

a first bearing disposed in the first portion of said bore adjacent said flange and around said axle between the axle and the sleeve;

a second bearing disposed in the bore at said bearing seat zone and around said axle between the axle and the sleeve; and a wheel mounted on and bonded to said sleeve.

2. An improved bearing and support structure as defined in claim 1 and further characterized in including axially extending ribs secured on the outer periphery of said sleeve circumferentially spaced from each other therearound and extending from said one end of the sleeve toward the second end thereof, said ribs frictionally engaging said wheel.

3. An improved bearing and support structure as defined in claim 1 wherein said bearings are ball bearing assemblies each having an inner race contacting said axle and an outer race contacting said sleeve, and wherein said axle terminates at a location spaced inwardly in said bore from the second end of said sleeve whereby the axle end is protectively shielded by said sleeve.

4. An improved bearing and support structure as defined in claim 1 wherein said sleeve is constructed of a high density polycarbonate synthetic resin.

5. An improved bearing and support structure as defined in claim 1 wherein the ends of said sleeve are substantially conterminous with the sides of the wheel mounted on the sleeve.

6. An improved bearing and support structure as defined in claim 1 wherein the axial distance from said one end of the sleeve to the flange is about 0.36 inch, and the axial distance from the second end of the sleeve to the flange is about 0.96 inch.

7. An improved bearing and support structure as defined in claim 1 wherein the radial thickness of said sleeve is about 0.125 inch.

8. An improved bearing and support structure as defined in claim 2 wherein said ribs extend axially over about half the length of the sleeve.

9. An improved bearing and support structure as defined in claim 2 wherein said sleeve is constructed of a high density polycarbonate synthetic resin.

10. An improved bearing and support structure as defined in claim 2 wherein the ends of said sleeve are substantially conterminous with the sides of the wheel mounted on the sleeve.

11. An improved bearing and support structure as defined in claim 2 wherein said bearings are ball bearing assemblies each having an inner race contacting said axle and an outer race contacting said sleeve, and wherein said axle terminates at a location spaced inwardly in said bore from the second end of said sleeve whereby the axle end is protectively shielded by said sleeve.

12. An improved bearing and support structure as defined in claim 11 wherein said sleeve is constructed of a high density polycarbonate synthetic resin.

13. An improved bearing and support structure as defined in claim 12 wherein said ribs extend axially over about half the length of the sleeve.

14. An insert sleeve for insertion in a wheel between the wheel and bearings around a supporting axle, the insert sleeve comprising:

a cylinder of high density synthetic resin having a bore of non-uniform diameter extending therethrough;

an annular spacer flange disposed in the bore of the cylinder and projecting radially inwardly into the cylinder toward the axis thereof for retaining a pair of bearing elements spaced from each other in the bore of the cylinder; and a plurality of circumferentially spaced axially extending ribs on the outer periphery of the cylinder and projecting from one end thereof toward the other end thereof over less than the full length of the cylinder;

said cylinder having a bore therethrough which includes a first portion of uniform diameter extending from one end of the cylinder to said annular spacer flange, and a second portion between said spacer flange and the other end of the cylinder, said second portion including a bearing seat zone of uniform diameter in the bore and located adjacent said spacer flange, with the remainder of said second portion extending from said bearing seat zone to said other end of the cylinder and having a continuously increasing diameter from said bearing seat zone to said other end of the cylinder.

* * * * *